United States Patent [19]

Thioulouse et al.

[11] Patent Number: 4,963,861

[45] Date of Patent: Oct. 16, 1990

[54] ELECTROLUMINESCENT MEMORY DISPLAY HAVING MULTI-PHASE SUSTAINING VOLTAGES

[75] Inventors: Pascal Thioulouse, Paris; Jean-Pierre Budin, L'Hay-Les-Roses, both of France

[73] Assignee: Etat Francais represente par le Ministre des Postes et Telecommunications Centre National, Issy les Moulineaux, France

[21] Appl. No.: 464,650

[22] Filed: Jan. 11, 1990

Related U.S. Application Data

[63] Continuation of Ser. No. 136,805, Dec. 22, 1987, abandoned.

[30] Foreign Application Priority Data

Dec. 22, 1986 [FR] France ..... 86 17985

[51] Int. Cl.[5] ..... G09G 3/30

[52] U.S. Cl. ..... 340/781; 340/805; 340/811; 340/794; 315/169.3

[58] Field of Search ..... 340/781, 805, 811, 794, 340/825.81; 315/169.1, 169.3; 313/500, 505, 506, 507

[56] References Cited

U.S. PATENT DOCUMENTS 4,035,774 7/1977 Chang ..... 340/781
4,613,793 9/1986 Panicker et al. ..... 340/781
4,733,228 3/1988 Flegal ..... 340/781

FOREIGN PATENT DOCUMENTS 0032196 7/1981 European Pat. Off. .
2602897 2/1988 France .
133859 12/1985 Japan .
WO86/03871 7/1986 PCT Int'l Appl. .

OTHER PUBLICATIONS

IBM Technical Disclosure Bulletin, "Power-Reduced Drive System for Plasma Panel" by W. J. Martin, vol. 21, No. 4, Sep. 1978, pp. 1520-1521.

*Primary Examiner*—Jeffery A. Brier
*Attorney, Agent, or Firm*—Foley & Lardner, Schwartz, Jeffery, Schwaab, Mack, Blumenthal & Evans

[57] ABSTRACT

A display includes at least one layer having a memory effect electro-optical property and enclosed between first and second families of electrodes. The display also includes a generator suitable for generating a plurality of voltages at different phases. At least one of the families of electrodes is subdivided into at least two subfamilies of parallel electrodes receiving respective different phase sustain voltages. This gives rise to a considerably drop in electrical power consumption, to an improved manufacturing yield, and makes it possible to provide larger-sized displays and/or operation at a higher image-writing speed, etc.

13 Claims, 6 Drawing Sheets

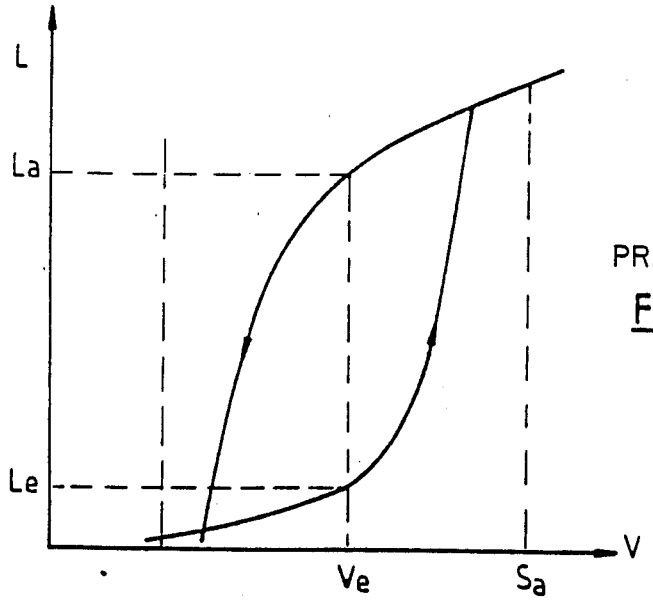
PRIOR ART
FIG. 1a
PRIOR ART
FIG 1b
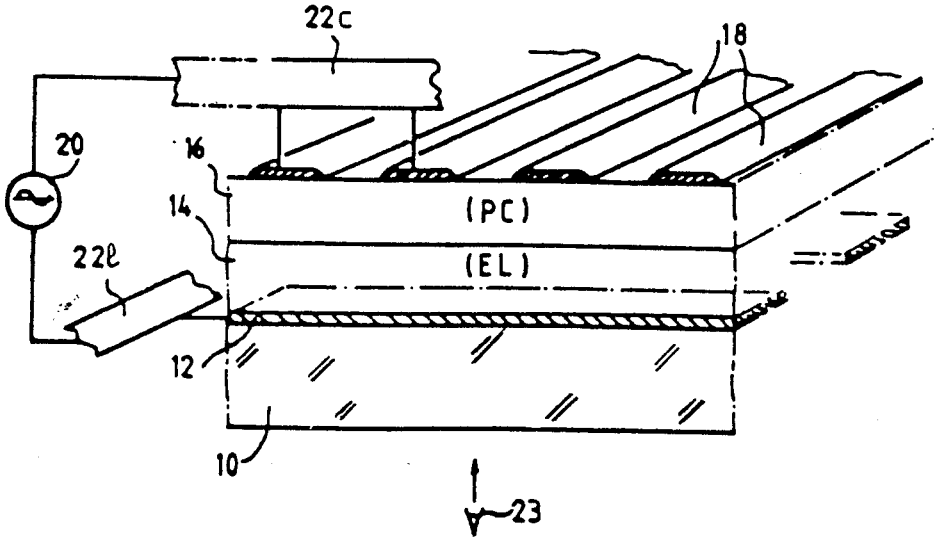

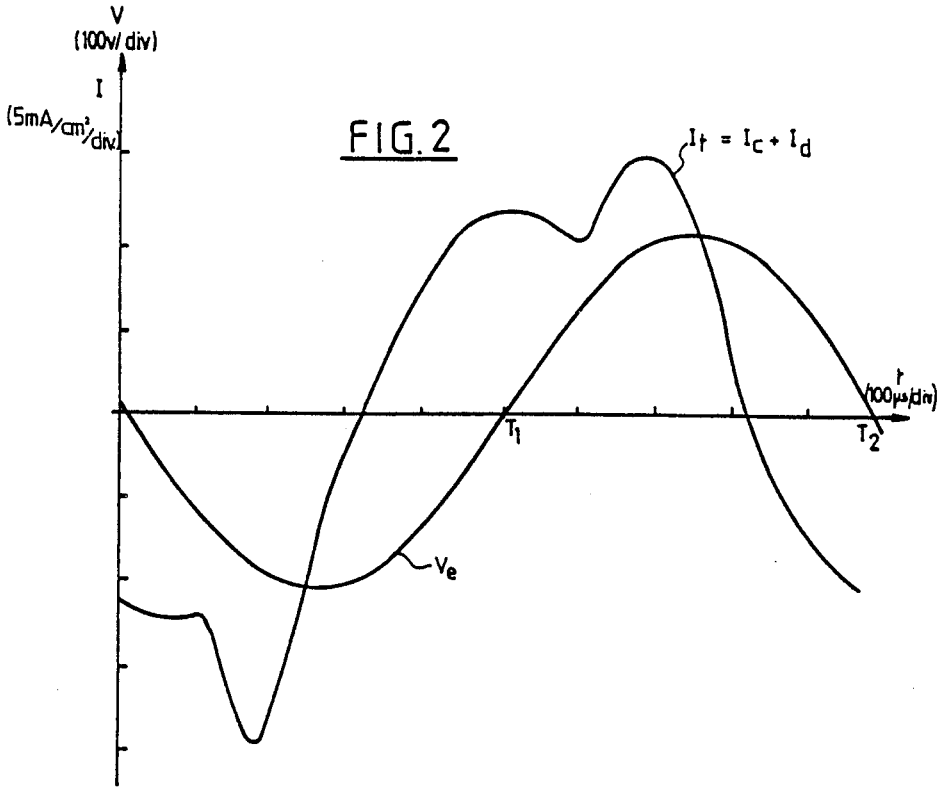
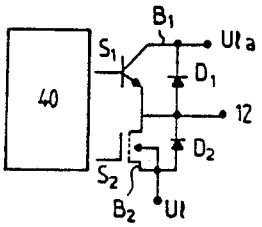
PRIOR ART
FIG. 3

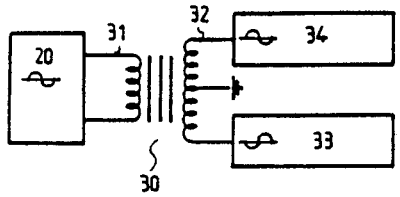
FIG. 4
FIG. 5
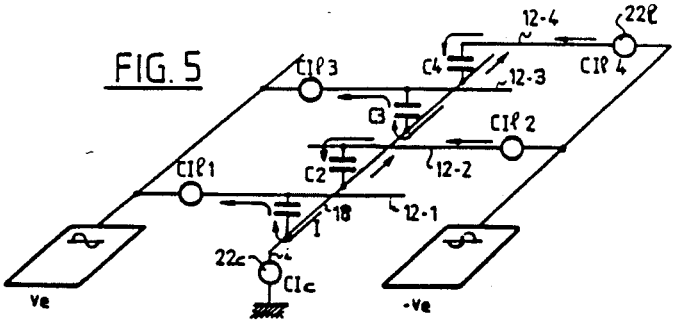
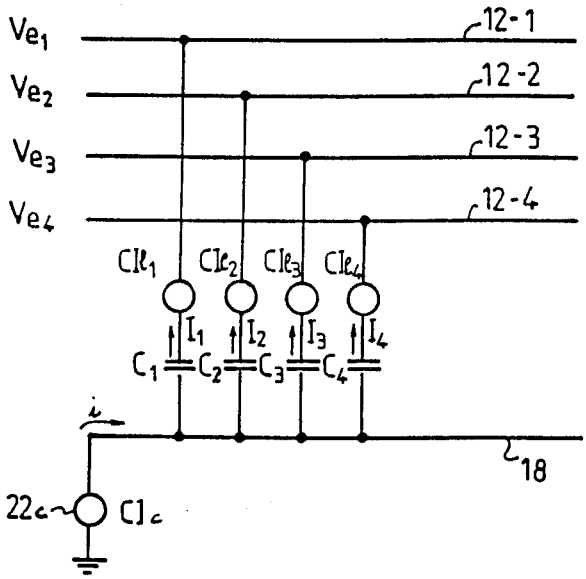
FIG. 6

ELECTROLUMINESCENT MEMORY DISPLAY HAVING MULTI-PHASE SUSTAINING VOLTAGES

This application is a continuation of application Ser. No. 07/136,805, filed Dec. 22, 1987 now abandoned.

The invention is applicable in opto-electronics for making memory effect electroluminescent displays.

BACKGROUND OF THE INVENTION

The invention is applicable to any type of memory effect electroluminescent display. An electroluminescent display is said to possess a memory effect when the electro-optical property of the display presents a hysteresis loop having two stable operating states. FIG. 1*a* is a diagram of the hysteresis loop of the electro-optical property of an electroluminescent display exhibiting the memory effect. Display luminance L is plotted up the Y-axis and the electrical voltage V applied to the display is plotted along the X-axis. The more luminous state $L_a$ is called the ON state and the less luminous state $L_e$ is called the OFF state. In order to switch the display from the OFF state to the ON state, the voltage applied to the display is temporarily increased up to a value $S_a$ situated beyond the hysteresis loop. Conversely, the display is switched off simply by temporarily reducing the applied voltage. A "sustain" voltage $V_e$ is permanently applied to the entire display in order to hold all of the pixels in the states they are in.

At present there are two types of memory effect electroluminescent display: there are displays with an inherent memory effect which is obtained when the display includes an electroluminescent layer based, for example, on manganese-activated zinc sulfide interposed between two dielectric layers; and there are extrinsic memory effect displays which are obtained when the display includes a photoconductive layer superposed on an electroluminescent layer.

FIG. 1*b* shows an example of an electroluminescent display including a photoconductor. The experimental data described below come from a display of this type. However, a display with an inherent memory effect behaves in a similar manner.

An electroluminescent display having a photoconductor comprises a transparent substrate 10, a first set of parallel transparent electrodes or "row" electrodes 12 (with it being assumed that the perspective section shown is taken along one of these rows), an electroluminescent layer 14, a photoconductive layer 16, and a second set of parallel transparent electrodes or "column" electrodes 18 extending perpendicularly to the row electrodes 12.

The row and column electrodes are powered from an A.C. voltage generator 20. More precisely, the row electrodes 12 are connected to the generator 20 via a row driving circuit $\mathbf{22}_l$ and the column electrodes 18 are connected via a column driving circuit $\mathbf{22}_c$. Observation preferably takes place through the substrate 10 as represented by an eye 23.

The display screen comprises pixels each of which is defined as the overlap zone between a particular row electrode and a particular column electrode. The display per se is, for example, of the PC-EL type, i.e. it is constituted by two layers 14 and 16, one of which is electroluminescent (EL) and the other of which is photoconductive (PC). It will be understood that when the electroluminescent layer is excited, the light which it emits increases the conductivity of the photoconductive layer and consequently increases the conductivity of the PC-EL display itself at the pixel under consideration. Thus, once a pixel has been excited, it can be kept on by applying a sustain voltage thereto, thereby ensuring that said pixel continues to be displayed.

Initially, the driving circuits $\mathbf{22}_l$ and $\mathbf{22}_c$ apply an alternating "sustain" voltage $V_e$ permanently to all of the pixels of the screen, said voltage being taken from the generator 20. More precisely, the row driving circuit $\mathbf{22}_l$ applies a potential $U_l$ to the row electrodes while the column driving circuit $\mathbf{22}_c$ applies a potential $U_c$ to the column electrodes. The voltage across the terminals of each pixel is thus $U_l - U_c = V_e$. Hereafter, $U_c$ is taken as the reference potential or "ground", giving $U_c = 0$.

The structure of the displayed image is defined and/or modified by the driving function itself.

A conventional mode of driving consists in scanning the row electrodes of the memory display sequentially. Instead of applying the potential $U_l$, each selected row electrode is subjected to a potential $U_{la}$, which is greater than $U_l$.

Simultaneously, the driving circuit $\mathbf{22}_c$ applies a potential $U_{ca}$ which is less than $U_c$ to those of the column electrodes crossing the excited row electrode at points where there are pixels to be switched on. It is ensured that $U_{la} - U_{ca}$ is greater than a threshold $S_a$ suitable for switching on a previously off pixel, i.e. a pixel at which the photoconductive layer is in a low conductivity state. Thereafter, the alternating sustain voltage $V_e$ is sufficient for keeping switched on those pixels which have been excited in this way.

Conversely, in order to switch a pixel off, a potential $U_{le}$ which is less than $U_l$ is applied to the selected row electrode and/or a potential $U_{ce}$ greater than $U_c$ is applied to the corresponding column electrode, with said potentials being applied for a short period of time. The total voltage applied to the corresponding pixels then falls during the short instant of time beneath a second threshold $S_e$ (which is less than $S_a$) thereby switching off the pixel. The sustain voltage then has no effect on the pixel because of the increased resistance of the photoconductive layer once the pixel has been switched off.

Since the voltages concerned are alternating voltages, the threshold conditions to be satisfied are naturally taken in terms of their peak values.

The switch-off time of memory effect electroluminescent displays is much longer than the switch-on time, with the switch-off time being much greater than one millisecond while the switch-on time is less than 100 microseconds. The optimum method of switching off pixels is therefore different from the above-described switch-on method. For example, it is better to switch off all of the pixels in several rows simultaneously by acting directly on the sustain voltage prior to writing any message. However, in order to simplify the description, it is given in terms of a sequential switch-off method even though the invention is applicable to both methods of switching off.

The various voltage values that need applying to the pixels are associated with currents whose peak values constitute an essential factor concerning the performance and the price of a memory display. The voltage drop along the electrodes due to their resistance must not exceed certain limits, thereby limiting the size of the screen. Also, the cost of the electronic driving circuits is very largely due to the amount of current that they are required to be capable of modulating.

The alternating sustain voltage $V_e$ produces a sustain current through the memory display. This sustain current comprises both a displacement current $I_d$ which is independent of the number of pixels which are switched on, and a conduction current $I_c$ which, in contrast, is proportional to the number of pixels switched on. The driving circuits 22 have both of these currents flowing through them simultaneously. The maximum value of the total current $I_t(t)=I_c(t)+I_d(t)$ is obtained when all of the pixels are switched on.

FIG. 2 is a waveform diagram showing the alternating sustain voltage $V_e$ and the total corresponding sustain current $I_t$ for a single pixel which is assumed to be switched on.

A sustain cycle corresponds to one period of the alternating voltage $V_e$, i.e. to the time interval lying between instants 0 and $T_2$, for example. $T_2$ may be about 1 millisecond, for example.

During a sustain cycle, the alternating voltage $V_e$ reaches its peak value twice, once in the negative half cycle and once in the positive half cycle. In theory, it would therefore be possible to drive two rows sequentially during a single period of the sustain voltage. At a driving rate of 1 kHz, it is therefore conceivable to use a write speed of 2,000 rows per second. However, for practical reasons, some common integrated driving circuits can only switch single polarity voltages. As a result only one of the peaks in the alternating voltage $V_e$ can be used during one period thereof. The maximum writing speed is then only 1,000 rows per second.

Account now needs to be taken of the fact that the row electrodes are generally made of aluminum while the column electrodes are made of indium tin oxide. The row electrodes may also be made of indium tin oxide if it is desired to make a display which is completely transparent. Unfortunately, the resistance of the transparent electrodes 12 made of indium tin oxide is not negligible. However, if reference is made to FIG. 2, it can be seen that while sustaining all of the pixels defined by the overlap zones between the column electrodes and one of the row electrodes, the peak value of the total current $I_t$ is more or less in phase with the sustain voltage $V_e$ when all of the pixels are switched on. Consequently, a voltage drop occurs along the corresponding column electrode 18 and the value of this drop is at a maximum when the sustain voltage $V_e$ reaches its maximum value.

We now consider what happens when the extreme potential values $U_{la}$ and $U_{ca}$ are applied to the terminals of the pixel(s) which are to be excited. There is a switching current $I_{co}$ which corresponds to the row potential increase $U_{la}-U_l$ and the column potential increase $U_c-U_{ca}$. We now restrict ourselves to the currents flowing along the column electrodes during pixel switching, since the column electrodes have higher resistance due to being made of indium tin oxide.

The potential $U_c$ of the column electrodes corresponding to pixels which are not to be switched on is taken as the reference potential and may be equal to 0, for example. However, the column electrodes corresponding to pixels which are to be switched on are taken to a negative potential $U_{ca}$ for a time $T_c$. The capacitance per unit area of an off pixel is noted C. The switching current $I_{co}$ along a column electrode is thus defined by equation (I) (which is to be found in the appendix to the present description together with other equations). This current $I_{co}$ is added to the sustain current $I_c(t)+I_d(t)$ as defined above. It would therefore be desirable to offset the moments at which the column electrodes and the row electrodes are switched relative to the peaks in the sustain voltage $V_e$ in order to minimize the peak value of the total current flowing through the memory display, thereby reducing the maximum current level that needs to be specified for its circuits. This also serves to limit the voltage drop induced by said total current from one end to the other of the resistive electrodes, and in particular of the column electrodes 18.

From FIG. 2, it appears that there is no way of avoiding having the sustain current overlapping with the switching current $I_{co}$: there is no time interval during which pixel switching can take place while the sustain current is zero. The voltage drop from one end to the other of the column electrodes is thus increased during switching by an amount proportional to the peak value of the total current.

It is relatively easy to calculate the relative voltage drop from one end to the other of a resistive electrode when the sustain voltage has a sinusoidal waveform. This voltage drop is expressed in accompanying equation II, where R is the sheet resistivity in ohms/square, L is the length of the electrodes in centimeters, $\omega$ is the angular frequency of the sustain voltage, C is the capacitance per unit area of a switched-off pixel in nanofarads per square centimeter, and finally k is the factor by which said capacitance is multiplied when the pixel is on.

If it is now assumed that this relative voltage drop must remain less than a maximum A, the maximum height $L_M$ which a display screen can have is given by accompanying equation III. As a result it can be seen that constraints relating to sustaining and/or switching pixels impose a limit on the size of the display screen.

Further, the voltage drop which exists from one end to the other of the resistive electrodes (and in particular the electrodes 18 made of indium tin oxide) has the drawback of producing pixel switch-on and switch-off characteristics which are not uniform over the area of the memory display. This nonuniformity can even give rise to parasitic switching-on or to parasitic switching-off on the matrix screen.

The present invention seeks to provide a solution to this problem.

An aim of the invention is to reduce the peak value of the currents flowing in the column driving circuits and in the column electrodes or in the row and the column electrodes of a memory display.

Another aim of the invention is to increase the speed at which an image can be written.

SUMMARY OF THE INVENTION

The invention provides a memory effect electroluminescent display of any type (PC-EL, inherent, etc.). The memory structure is enclosed between first and second families of mutually orthogonal electrodes. A display point or pixel is defined by the zone where a particular electrode in one of the families crosses a particular electrode in the other family. The display also includes a generator suitable for producing an alternating sustain voltage for the electrodes together with driving means for selectively applying variations in voltage relative to the sustain voltage to electrodes in both families in order to address one or more particular pixels.

According to a general characteristic of the invention, the generator is suitable for producing a plurality of same-frequency alternating sustain voltages at different phases, and at least one of the two families of electrodes is subdivided into at least two subfamilies of parallel electrodes each of which receives a different one of the sustain voltage phases.

The reduction in the peak value and in the mean value of the currents flowing through the column driving circuit and in the column electrodes provides several advantages. Firstly, the display consumes less power. Secondly the reduction in the current flowing through the driving circuits makes it possible to use more common types of circuit and connector which are cheaper, thereby considerably reducing the manufacturing cost of a complete display.

Another substantial advantage lies in the increase in the maximum possible length of the resistive electrodes (in particular of the resistive electrodes 18 made of indium tin oxide), and consequently in the maximum height of the display screen.

Finally, the reduction in current also makes it possible to increase the speed at which an image is written by increasing the frequency of the sustain voltage $V_e$.

In a particular embodiment of the invention, the memory structure has a memory effect electro-optical property resulting from the superposition of a photoconductive layer and an electroluminescent layer. The electroluminescent layer may be made so as to emit at any desired color, and the photoconductive layer should have a matching composition.

According to another particular embodiment of the invention, the material of the memory structure having a memory effect electro-optical property is manganese-activated zinc sulfide, for example, or any other material having an inherent memory effect.

In another particular embodiment, two sustain voltages are in phase-opposition relative to each other and are each applied to one of the two subfamilies of electrodes.

In another particular embodiment, four sustain voltages are in phase-quadrature relative to one another and each of them is applied to one of four subfamilies of electrodes.

Another advantageous variant of the invention consists in using three sustain voltages at electrical phase differences of 120° relative to one another, in conjunction with three subfamilies of electrodes.

Regardless of the number of subfamilies of electrodes, and thus of the number of different voltage phases, the electrodes belonging to the subfamilies are connected in such a manner that the electrodes following one another on the screen belong to each of the subfamilies in turn and appear in the same order over the entire screen or else in a variable order (interleaved networks).

In accordance with another aspect of the invention, the various alternating voltages required by the voltage generator are produced by means of a transformer.

Preferably, the family of column electrodes is made of indium tin oxide and the family of row electrodes is made of aluminum.

Advantageously, in order to make an entirely transparent display, the row and column families of electrodes are both made of indium tin oxide.

In a completely transparent display, the other one of the two families of electrodes is also divided into at least two subfamilies of parallel electrodes receiving respective different sustain voltage phases.

Advantageously, the variations in voltage relative to the sustain voltage for the purpose of modifying the displayed image occur during time intervals lying between the sustain current peaks in the electrodes of the subfamily under consideration.

In a preferred embodiment of the invention, the pixel driving means comprise single polarity or two-polarity driving circuits of the push-pull type.

BRIEF DESCRIPTION OF THE DRAWINGS

Embodiments of the invention are described by way of example with reference to the accompanying drawings, in which:

FIG. 1*a*, already mentioned above, is a diagram of a hysteresis loop showing the electro-optical property of a display of known type;

FIG. 1*b*, already mentioned above, is a perspective section view through a prior art PC-EL type display;

FIG. 2, already mentioned above, is a waveform diagram relating to a prior art matrix driving method for the FIG. 1 display;

FIG. 3 is a diagram of the equivalent circuit of one example of a row driving circuit for use in driving the pixels of a memory display in accordance with the invention;

FIG. 4 is a circuit diagram of a voltage generator coupled to a transformer in order to produce two control voltages in phase-opposition;

FIG. 5 is a diagrammatic illustration of a first embodiment of the invention using the FIG. 4 generator;

FIG. 6 is a diagram of the equivalent circuit of a memory display in accordance with the invention;

Figure 7:
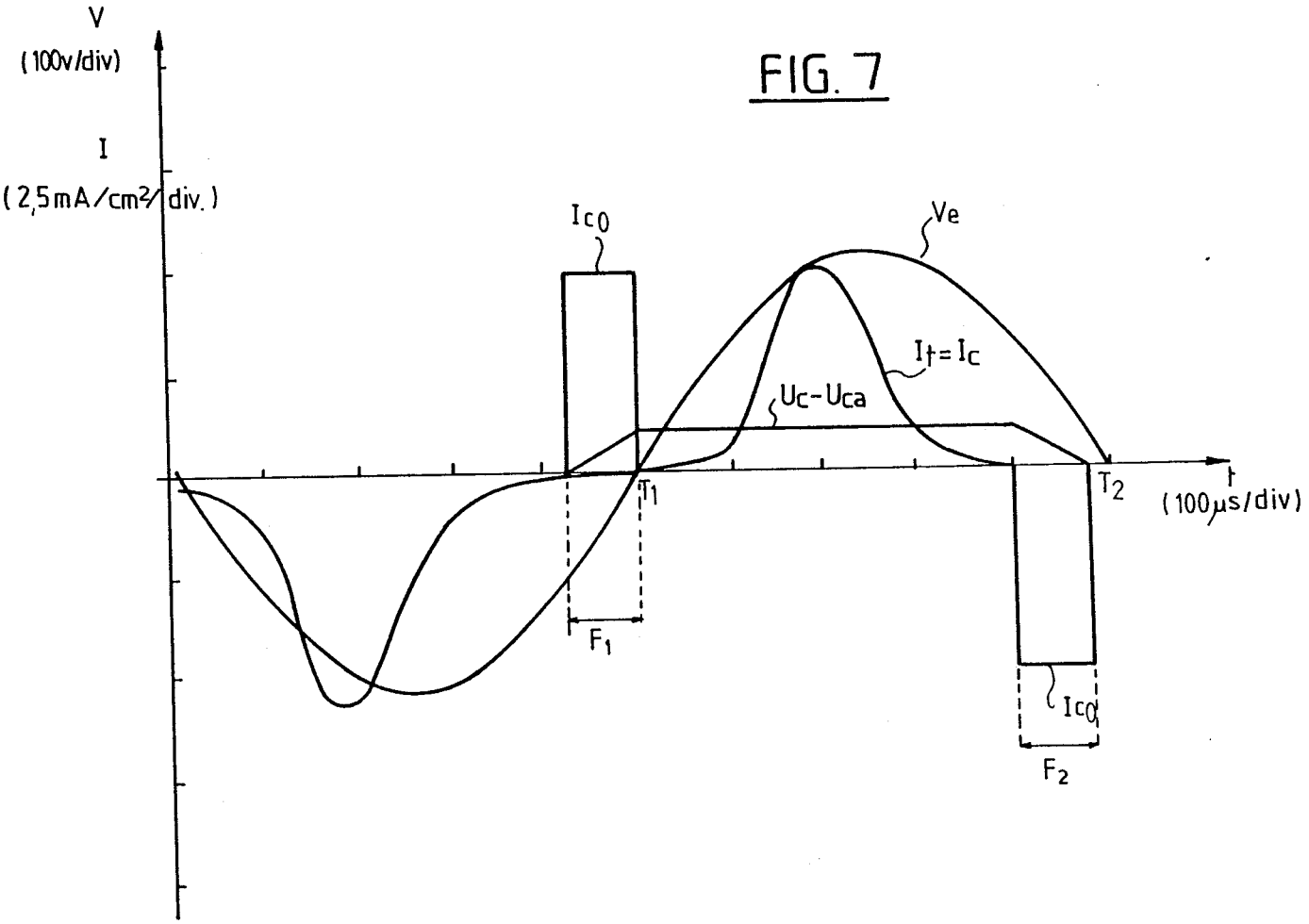
FIG. 7 is a waveform diagram showing pixel control when the voltages applied to the two subfamilies of row electrodes are in phase-opposition.

In several respects, the accompanying drawings include information which is definitive in nature. In addition, geometry is a consideration of substance in a device in accordance with the invention. As a result, the accompanying drawings serve not only to improve understanding of the present invention, but may also contribute to defining the invention, wherever necessary.

MORE DETAILED DESCRIPTION

FIG. 3 shows the equivalent circuit of one example of a driving circuit for use in driving pixels in a memory display in accordance with the invention.

By way of example, this description relates to the row driving circuit $\mathbf{22}_l$, but the column driving circuit $\mathbf{22}_c$ behaves similarly (apart from the fact that the signs of the voltages are inverted).

Row driving circuit $\mathbf{22}_l$ serves to apply a potential $U_l$ to those row electrodes in which pixels are not to be switched, and to apply a potential $U_{la}$ which is less than $U_l$ to those row electrodes in which pixel switching is to take place.

The driving circuit $\mathbf{22}_l$ comprises two parallel loops $B_1$ and $B_2$ each comprising a transistor S, a diode D, an input, and an output. The input to the loop $B_1$ is subjected to the potential $U_{la}$ while the input to the loop $B_2$ is subjected to the potential $U_l$. The output from both loops is common and is connected to a row electrode 12. The transistors $S_1$ and $S_2$ act as switches and they are controlled via their bases by a logic stage 40 which conveys the data required for selecting the row electrodes engaged in pixel switching.

The transistor $S_1$ is a bipolar NPN type transistor and the transistor $S_2$ is an NMOS field effect transistor (FET). The transistors of the loops $B_1$ and $B_2$ thus give the circuit $22_l$ the so-called "push-pull" configuration. The circuit $22_l$ is a single polarity circuit insofar as $U_l$. $-U_{la}$ has a sign which is determined by the diodes $D_1$ and $D_2$ connected in parallel with the transistors $S_1$ and $S_2$. The circuit 22 could be made into a two-polarity circuit by replacing the diodes $D_1$ and $D_2$ with transistors.

A first means of reducing the currents flowing through the display is to subdivide the family of row electrodes into two parallel subfamilies of electrodes receiving two respective control voltages which are in phase-opposition relative to each other.

FIG. 4 is a diagram of a voltage generator coupled to a transformer which provides a phase offset between the control voltages so as to provide two voltages which are in phase opposition relative to each other. The transformer 30 is a transformer whose primary winding 31 is coupled to an alternating voltage generator 20 delivering the sustain voltage. The mid-point of the secondary winding 32 is grounded. The ends of the secondary winding therefore provide two alternating voltages 33 and 34 which are in phase opposition relative to each other. It is possible to obtain two voltages in phase-opposition by other means, in particular by electronic logic means.

FIG. 5 is a diagram of a first embodiment of a memory display using the generator of FIG. 4. One column electrode 18 and four row electrodes 12 (individually referenced 12-1 to 12-4) can be seen. Each electrode is fed with voltage from a respective driving circuit 22. The four row electrodes 12 are split up into two subfamilies of row electrodes: in one of the two subfamilies the electrodes 12-1 and 12-3 receive a potential $V_e$ delivered by the voltage generator 20 via row circuits $CI_{l1}$ and $CI_{l3}$; in the other of the two subfamilies, the electrodes 12-2 and 12-4 receive a potential $-V_e$ which is in phase-opposition relative to $V_e$ and which is likewise delivered by the voltage generator 20 via circuits $CI_{l2}$ and $CI_{l4}$. The column electrode 18 is connected to the potential $U_c$ or $U_{ca}$ by the driving circuit $22_c$. Finally, the four pixels defined by the respective overlap zones between the four row electrodes and the column electrode have respective capacitances $C_1$ to $C_4$. As can be seen from reference $CI_{l1}$, in this typeface the digit "1" and the lower case letter "l" are distinct.

FIG. 6 is an equivalent circuit of the memory display. It comprises, by way of example, four sustain voltages $V_{e1}$ to $V_{e4}$ which are at electrical phase differences of 90° relative to one another. A group of four row electrodes (individually referenced 12-1 to 12-4) each has a pixel which is represented diagrammatically by its respective capacitance $C_1$ to $C_4$. The group constitutes one elementary period of the space frequency of electrodes and pixels in the family under consideration, i.e. the row family in this example.

In general, the elementary period of the memory display having l multiple-phase sustain voltages, where l is an integer, comprises l electrodes each connected to one of these voltages by means of family driving circuits.

Since the phases of the sustain voltages are regularly distributed around 360°, the sum of the displacement currents $\vec{I_1}+\vec{I_2}+\ldots+\vec{I_l}$ is zero, adopting the sign convention denoted by arrows in FIG. 6 which illustrates the special case of $l=4$. As a result, the current referenced i in FIG. 5 and in FIG. 6, passing through the column driving circuit $22_c$ (or more generally the circuit of the other family) is never greater than about one of the currents I. The current flowing along the resistive column electrode is likewise of the same order of magnitude of one of the currents I, and is always less than said current. It is thus very considerably reduced in comparison with the case where feeding takes place using a single phase as in the prior art, since in that case the current i is equal to the product of the number of electrodes of the family multiplied by the value of the current I.

It can be shown that the current flowing along the resistive electrode of a multi-phase fed screen is respectively $\frac{1}{2}$, $1/\sqrt{3}$, and $1/\sqrt{2}$ times the current I for the 2, 3, and 4 phase cases respectively. As a result the voltage drop induced by said current is negligible.

It would also be understood that the invention provides its greatest effect when the subfamilies are thoroughly interleaved, as indicated in FIG. 6 for the four phase case.

In the general case of a memory electroluminescent screen, the pixels in the ON state do not behave in a purely capacitive manner. When the l pixels are all in the same state (ON or OFF) within a single space frequency period as defined above, the current outside the loop is zero. In contrast, the compensation effect is no longer completely effective when some pixels are on and others are off. However, the compensation effect is still useful since the displacement current is still cancelled. If this compensation effect is integrated over an entire column electrode, it can be seen that the least favorable condition in terms of residual current is the condition in which the pixels defined by the overlap zones between the first subfamily of row electrodes and the column electrodes are off while the pixels defined by the overlap zones between the second subfamily of row electrodes and the column electrode are on. In this case, the conduction current $I_c$ is not compensated at all. However, even in this case, the peak value of the current flowing from one end to the other of the column electrode and through its driving circuit is still significantly reduced compared with the least favorable condition in the prior art memory display which is when the entire column is on.

Further, the displacement current is very considerably compensated regardless of the distribution of on and off pixels.

The current i which returns to the column driving circuit is responsible for the voltage drop in the column electrode.

The current i is obtained as the difference between the total current flowing along one of the subfamilies of row electrodes crossing the column electrode and the current flowing along the other subfamily(ies) of row electrodes crossing the column electrode. In the most unfavorable condition in terms of residual current flowing through a display in accordance with the invention as described above, the value of i is given by accompanying equation IV:

$$I(t) = \frac{Ld}{l}(I_{on}(t) - I_{off}(t)) \quad \text{(IV)}$$

where

L is the length of the electrode, d is the width of the electrode, l=2, $I_{on}(t)$ is the current density through an on pixel, $I_{off}(t)$ is the current density through an off pixel.

In the least favorable conditions for a prior art memory display, i.e.,:

$$I(t)=Ld\, I_{on}(t) \quad \text{(V)}$$

when all the pixels along a column electrode are on, i has the value given by accompanying equation V.

FIG. 7 is a waveform diagram showing pixel control in the special case of the invention using two sustain voltages in phase opposition. The sustain voltage $V_e$ applied to the electrodes is shown together with the associated total sustain current $I_t$. As described with reference to FIG. 5, $I_d$ is compensated in accordance with the invention, and $I_t$ is therefore represented solely by a current whose variation as a function of time is the same as the variation in $I_c$. The current saving relative to the display described with reference to FIG. 2 is even greater when the on pixel is in a lower excitation state. Lower excitation corresponds to injecting fewer electrons into the electroluminescent layer. This is applicable, in particular, to an inherent memory display or to a PC-EL memory display having different characteristics for its PC layer. This also corresponds to a lower sustain voltage within the display. The conduction current then becomes less important relative to the displacement current.

As a result, in the example described with reference to FIG. 2, the current density per unit area for i is about 20 milliamps per square centimeter, whereas for a display in accordance with the invention and when using two-phase drive, the density of the current i is about 6 milliamps per square centimeter.

If we take the case of a column electrode of length L=10 centimeters and of width d=300 micrometers with a filling factor of 70% along the column, (where "filling factor" is the ratio between the area of all the pixels in a column and the total area of the column electrode), the invention causes the peak current which a column driving circuit must be capable of providing to fall from 4 milliamps to 1.2 milliamps.

The first embodiment of a memory display as described with reference to FIG. 5 is equivalent to replacing kC by C.(k−1)/2 in accompanying equation III, by virtue of the displacement $I_d$ being compensated and by the fact that the illuminated area is half the size in the case which is most unfavorable in terms of residual current when compared with the prior art memory matrix display. This equation is applicable providing the two subfamilies are sufficiently interleaved for it to be possible to assume that the distribution of emission along a column is uniform. It has been shown that k generally has a value lying between 2 and 3, and as a result the improvement in maximum length $L_M$ which can be given to the displaced screen is by a factor of 1.7 to 2. In the following example, R=20 ohms per square, C=10 nanofarads per square centimeter, k=3, and $\omega=2\pi.1$ kHz, with a tolerance of 1% on the voltage $V_e$. A prior art PC-EL display has a maximum length $L_M$ of 10 centimeters whereas a display in accordance with the invention has a maximum length of $L_M$ of 17 centimeters.

It may be observed that the invention has no direct effect on the currents due to switching a column electrode. Switching conditions must therefore be chosen in such a manner that the switching currents $I_{co}$ do not either increase the peak values of the sustain current $I_c$ or excessively disturb the peak sustain voltage $V_e$, particularly at the end of the column. With reference to FIG. 7, the extra column-switching potential $U_c-U_{ca}$ is preferably chosen to be trapezoidal in shape. The plateau of this increase in potential coincides with the peak of the sustain voltage $V_e$. By virtue of the invention, the displacement current associated with the sustain voltage $V_e$ is fully compensated. The displacement current is therefore zero except at the moment that electrons are injected into the electroluminescent layer. With reference to FIG. 7, the current peak $I_c$ corresponds to the injection of sustain electrons into the electroluminescent layer. It can be seen that there are two windows $F_1$ and $F_2$ during which the sustain current is zero. These two windows last for about 300 microseconds for a display as described above with reference to FIG. 5. An improvement of the invention consists in placing the edges of the trapezoidal potential increase $U_c-U_{ca}$ in these two windows. In addition, under the following typical conditions: $I_{co}<6$ milliamps per square centimeter, C=10 nanofarads per square centimeter, and $U_c-U_{ca}=45$ volts; it can be seen that a time of about 75 microseconds suffices for applying an extra potential $U_c-U_{ca}$ to the column electrode without drawing a current of more than 6 milliamps per square centimeter. It is thus easy to include the edges of the trapezoidal extra switching potential in the windows where the sustain current is zero.

When the driving circuits are controlled by single polarity voltages, it is possible during a single sustain cycle to drive a row which is driven by a voltage $V_e$ and another row which is driven by a voltage $-V_e$, in phase opposition to each other. With reference to FIG. 5, a row is selected during the positive half cycle of $V_e$, i.e. during the time interval running from $T_1$ to $T_2$, while the other row is selected during the other half cycle of $V_e$, i.e. during the time interval running from 0 to $T_1$. In this way, a writing speed of 2,000 rows per second can be obtained for a sustain voltage at a frequency of 1 kHz, which is twice the writing speed that can be obtained in the prior art circuit described with reference to FIG. 2.

The first means for reducing the currents flowing in a display in accordance with the invention by subdividing the family of row electrodes into two subfamilies of parallel electrodes receiving respective control voltages which are in phase-opposition relative to each other thus makes it possible, in comparison with the prior art display, to reduce the peak current flowing through the column driving circuits by a factor of 3 to 4, thereby also increasing the maximum possible length of the column electrodes by a factor of 1.7 to 2, and simultaneously doubling the image writing speed.

More generally, the means for reducing the currents flowing through a memory display in accordance with the invention consists in subdividing the family of row electrodes into a plurality of subfamilies of parallel electrodes which receive as many respective control voltages as there are regularly distributed phases over $2\pi$ radians, by way of nonlimiting illustration, we describe below the case of four voltages being used in phase quadrature.

We begin by dividing the family of n row electrodes into two groups $R_1$ and $R_2$. Potentials $U_{l1}$ and $U_{l2}$ in phase quadrature are then applied to these two groups of rows each having n/2 electrodes. Thereafter, each of the groups $R_1$ and $R_2$ is subdivided as described with reference to FIG. 5 so that the two groups $R_1$ and $R_2$ of n/2 row electrodes each are thus re-divided into two subgroups having n/4 row electrodes each, with one of the subgroups using a sustain potential $U_{l1}$ or $U_{l2}$ and with the other using a sustain potential $-U_{l1}$ or $-U_{l2}$. Preferably, both of the subgroups of each group $R_1$ and $R_2$ are interleaved or even interlaced. In this way, the sustain displacement currents are compensated.

The most unfavorable condition for reducing the currents flowing through the display is the condition in which the pixels of one of the subgroups of row electrodes in group $R_1$ and in group $R_2$ are all on while the pixels in the other subgroups are all off. In this case, no advantage can be had from compensation of the conduction currents in the resistive column electrodes. However, there is no overlap between the two conduction current peaks relating to $R_1$ and $R_2$.

Figure 8:
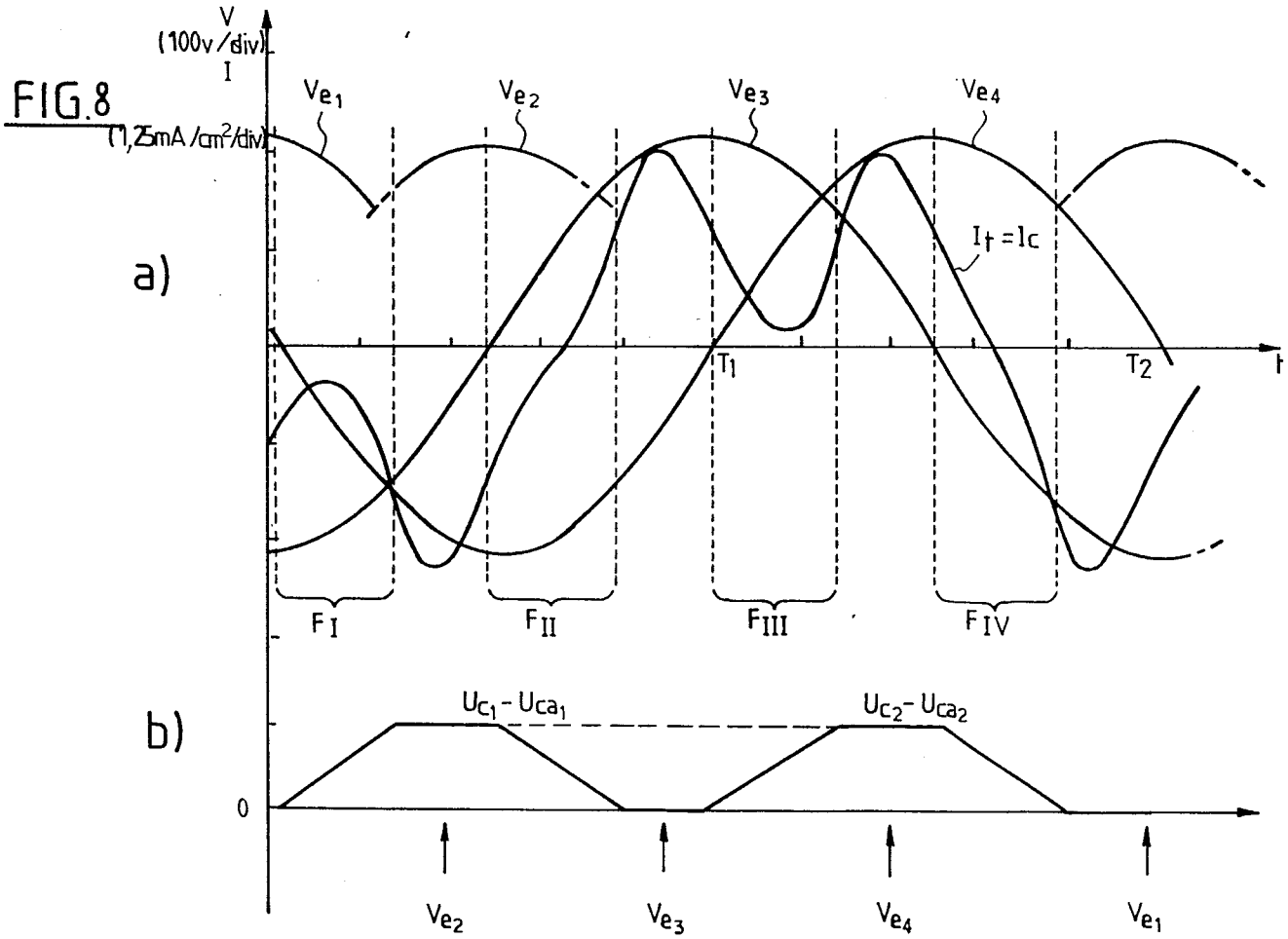
FIG. 8 is a waveform diagram relating to a variant of the invention in which the voltages applied to the row electrodes are in phase-quadrature.

Portion (a) of FIG. 8 is a waveform diagram showing pixel control when the voltages applied to the row electrodes are in phase quadrature relative to one another. Four sustain voltages $V_{e1}$, $V_{e2}$, $V_{e3}$, and $V_{e4}$ are shown which are in phase-quadrature relative to one another. The total sustain current $I_t$ associated with these voltages is also shown in the most unfavorable condition of all of the pixels in the subfamilies driven by $V_{e3}$ and $V_{e4}$ being on while the others are off. In accordance with the invention, the total sustain current is thus represented solely by a current which varies in proportion to its component $I_c$.

In portion (a) of FIG. 8, it can be seen that under the most unfavorable conditions, the maximum peak value of the total current $I_c$ is equal to the value of its constituent peaks. But each peak corresponds to the emission of n/4 column electrode pixels only. By virtue of the invention, an improvement by a factor of 2 is obtained over the value of the current peak as obtained in the display described with reference to FIG. 5. Under the experimental conditions described with reference to FIG. 5, the invention therefore provides an improvement by a factor of 7 on the current supplied to the column driving circuits when compared with the prior art display described with reference to FIGS. 1 and 2.

If the groups $R_1$ and $R_2$ are themselves interleaved as shown diagrammatically in FIG. 6, it may be assumed that emission from each of the groups is uniform along a column. Thus, the invention makes it possible to replace kC in accompanying equation III with C.(k−1)/4, and the resulting improvement on the maximum admissible length $L_M$ is by a factor of 2.4 to 2.8. In the above-described example, it is possible to obtain a length $L_M$ of 24 centimeters with a tolerance of 1% on the voltage.

As in the display described with reference to FIG. 7, it is necessary to make sure that the column switching currents $I_{co}$ do not increase the peak values of the sustain current. Thus, under the following typical conditions: $I_{co}<3$ milliamps per square centimeter, C=10 nanofarads per square centimeter, and $U_{ca}=45$ volts; it can be seen that a time of about 150 microseconds suffices for applying an increase in column potential $U_c-U_{ca}$ to a column electrode without providing a current of more than 3 milliamps per square centimeter.

With reference to portion (a) of FIG. 8, it can be seen that there are four windows $F_I$, $F_{II}$, $F_{III}$, and $F_{IV}$ having a duration of about 150 microseconds between the four peaks in the conduction current. These windows thus make it possible to switch a column electrode in phase with the maximum of any one of the four sustain voltages.

In portion (b) of FIG. 8, there is a waveform diagram showing the switching of a column electrode when the voltages applied to the row electrodes are in phase-quadrature relative to one another. Two increases in column switching potential $U_{c1}-U_{ca1}$ and $U_{c2}-U_{ca2}$ are shown, both of which are trapezoidal in shape. These two increases in potential correspond in this example to switching on pixels addressed by the row electrodes subjected to $V_{e2}$ and $V_{e4}$. The pixels addressed by the row electrodes subjected to $V_{e1}$ and $V_{e3}$ are off in this case. The dashed line between the two increases in switching potential $U_{c1}-U_{ca1}$ and $U_{c2}-U_{ca2}$ represents the increase in switching potential corresponding to switching on the pixels addressed by the row electrodes subjected to $V_{e3}$.

By virtue of the invention, single polarity driving circuits can be used to drive four rows per sustain cycle. This increases the speed at which an image can be written to up to 4,000 rows per second.

The particular means for reducing currents flowing in a display in accordance with the invention by subdividing the family of row electrodes into four subfamilies of parallel electrodes receiving four control voltages which are respectively in phase-quadrature relative to one another thus makes it possible, in comparison with the prior art display described with reference to FIGS. 1 and 2, to reduce the peak current flowing along the column driving circuits by a factor of 7, and also to increase the maximum length of the column electrodes by a factor of 2.4 to 2.8 while quadrupling the speed at which an image can be written.

In the particular case when a three-phase alternating voltage generator is used, the corresponding means for reducing the currents flowing through the display is to subdivide the family of row electrodes into three subfamilies of parallel electrodes receiving three respective control voltages which are at phase differences of 120 electrical degrees relative to one another.

Figure 9:
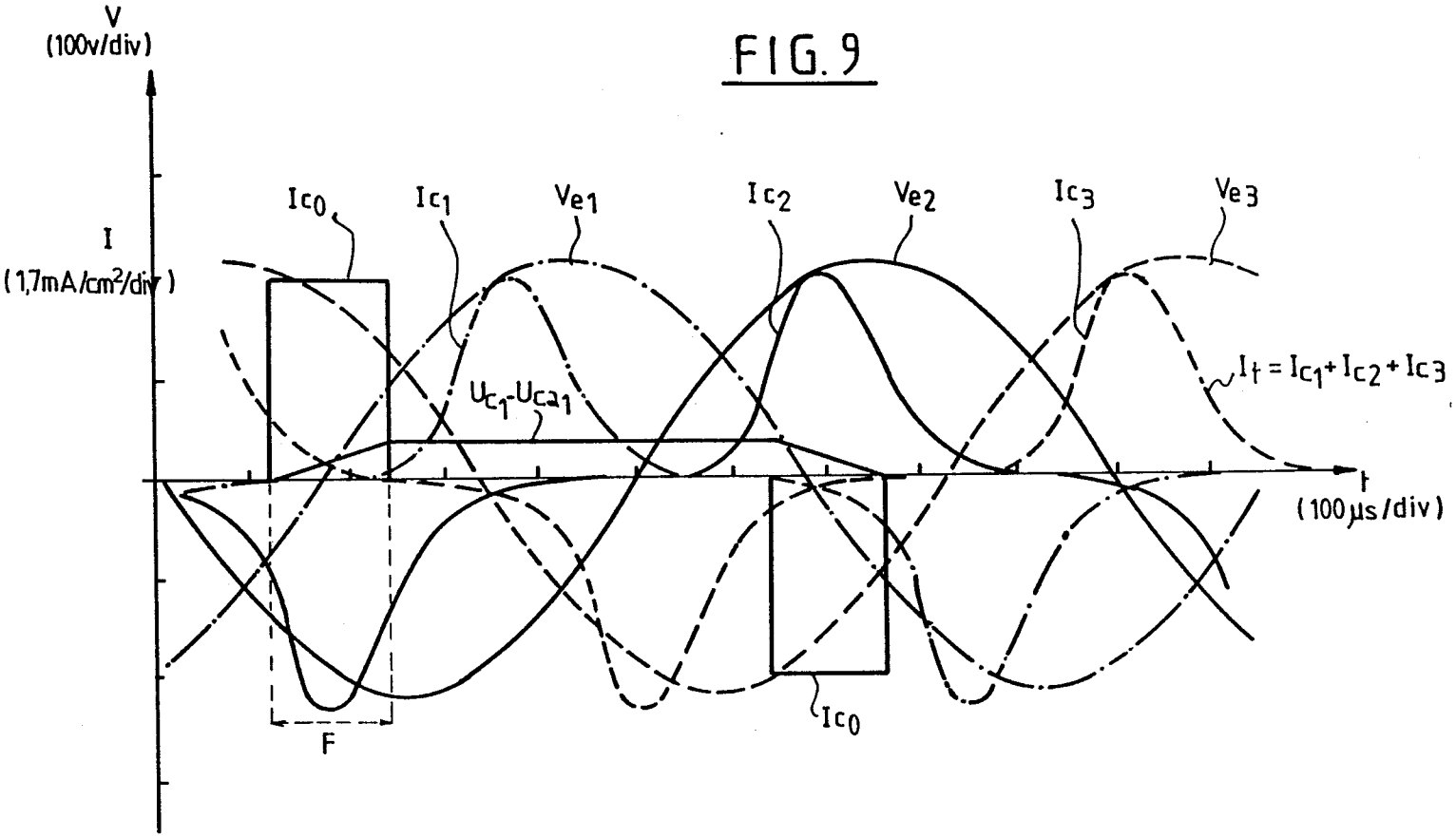
FIG. 9 is a waveform diagram showing another variant of the invention when the voltages applied to three subfamilies of row electrodes are at phase differences of 120 electrical degrees relative to one another.

FIG. 9 shows three sustain voltages $V_{e1}$, $V_{e2}$, and $V_{e3}$ which are at intervals of 120 electrical degrees relative to one another. The total sustain current $I_t$ associated with these voltages, by reasoning analogous to that used with reference to FIGS. 5 and 7, is equal to the conduction current $I_c$ since the displacement sustain current $I_d$ is fully compensated. The total sustain current $I_t$ is therefore represented by the sum of the conduction currents $I_{c1}$, $I_{c2}$, and $I_{c3}$ which are associated with the sustain voltages. These conduction currents are associated with a multiplying coefficient lying in the range 0 to 1 and representing the degree to which the pixels of the column electrodes belonging to the corresponding subfamily are switched on.

The most unfavorable condition for reducing the voltage drop from one end to the other of a column electrode is the condition in which the pixels of one of the three subfamilies are all on and all the other pixels are off. Compared with the prior art, this third means eliminates the sustain displacement current and reduces the peak values of the conduction current by a factor of 3 since each subfamily occupies an area equal to ⅓rd of the total area of the display. Compared with the example display described with reference to FIGS. 1 and 2, the peak current flowing along the column electrode and in the corresponding driving circuit drops from 20 milliamps per square centimeter to 4 milliamps per square centimeter, giving an improvement by a factor of 5.

It is likewise necessary to choose switching conditions which are matched to the sustain voltages so that the switching currents do not run the risk of exceeding the value of the peak sustain current. Each conduction current peak $I_c$ can only have one polarity, and only its amplitude is capable of varying as a function of the concentration of on pixels along the column electrode under consideration. It is therefore desirable to make the column electrode switching current coincide with a sustain current peak of opposite polarity. This prevents the peak currents from being summed. This advantageous method of proceeding is applicable when the number of sustain phases is odd, as in the present example.

With reference to FIG. 9, the switching current $I_{co}$ of a pixel which is held by sustain voltage $V_{e1}$ is caused to coincide in time with the sustain conduction current peaks $I_{c2}$ associated with the sustain voltage $V_{e2}$. Advantageously, the increase in switching potential $U_{c1}-U_{ca1}$ is trapezoidal in shape. In accordance with the typical conditions described with reference to FIG. 7, switching windows F having a duration of 150 microseconds are available. A window having a duration of 110 microseconds is sufficient for switching a column electrode from 0 to 45 volts without exceeding the switching current of 4 milliamps per square centimeter.

It is also possible to switch three pixels and thus three rows per sustain cycle. As a result the speed at which an image can be written is tripled compared with the display described with reference to FIGS. 1 and 2.

The invention may be generalized to a set of M sustain voltages which are at different phases relative to one another, which may be optionally be in phase-opposition in pairs, with each voltage being applied to a subassembly $R_i$ of n/i row electrodes.

In the present description of the invention, the sustain voltage has been in the form of a simple sinewave. However, the invention is applicable to any type of symmetrical bipolar voltage: triangular, rectangular, trapezoidal, or more complex. Constraints external to a display in accordance with the invention may require the use of asymmetrical bipolar sustain voltages. In this case, the invention can no longer be used to provide complete compensation for the displacement current, however it can still be reduced.

In order to facilitate understanding of the present invention, the description has been limited to simple sustain voltages and to pixel switching voltages. Naturally, the invention is also applicable to more complex sustain voltages making it possible to increase tolerances on pixel switch-on and switch-off voltages or else to shorten the time required for switching pixels on.

The invention may be combined with other techniques for reducing the current flowing through a PC-EL display, for example the technique described in French patent application No. 86.11.808 filed Aug. 18, 1986. This technique consists in using pixels with a low filling factor in a PC-EL display. A PC-EL screen may be designed having a filling factor of 1/35. Under these conditions, the current provided by the column driving circuits is 6/35 milliamps per square centimeter, i.e. 0.17 milliamps per square centimeter. As a result, peak currents of only 50 microamps are required for driving a column which is 10 centimeters long and 300 micrometers wide. In order to estimate the maximum length of column electrodes, kC in accompanying equation III is replaced by $C.(k-1)/(4\times 35)$. In contrast, a low filling factor of pixels gives rise to an increase in the resistance of the column electrodes, and therefore to the apparent sheet resistivity R. However, a suitable design of electrode makes it possible to limit this increase in R to a factor of no more than 2, i.e. to a typical value of 50 ohms. Under these conditions, an improvement is obtained by a factor of 9 to 10.5 in $L_M$ compared with the prior art, giving a value of $L_M$ of 1 meter for a tolerance of 1% on the sustain voltage.

APPENDIX $$I_{co} = \frac{C(U_c - U_{ca})}{T_c} \quad \text{(I)}$$

$$\frac{\Delta V_e}{V_e} = \frac{-1}{12}(kRC\omega)^2 \cdot L^4 \quad \text{(II)}$$

$$L_M = \frac{\sqrt[4]{12 \cdot A}}{\sqrt{kRC\omega}} \quad \text{(III)}$$

$$I(t) = \frac{Ld}{l}(I_{on}(t) - I_{off}(t)) \quad \text{(IV)}$$

$$I(t) = Ld \cdot I_{on}(t) \quad \text{(V)}$$

We claim:

1. A memory effect electroluminescent display comprising:

a first set of parallel electrode members;

a second set of parallel electrode members, orthogonal to those of the first set;

at least one layer having a memory effect electro-optical property and enclosed between said first and second sets of electrode members;

each particular electrode member of said first set crossing each particular electrode member of said second set at an overlap zone defining a particular pixel of said display;

AC sustain voltage generator means having a first terminal for coupling a first potential to the electrode members of said first set and a second terminal for coupling a second potential to the electrode members of said second set, so as to apply permanently therebetween an AC voltage for sustaining a present condition of said pixels;

means for selectively altering the AC voltage between certain of the first and second electrode members, so as to change the condition of the corresponding pixels;

said display including the improvement that;

said AC sustain voltage generator means has at least two first terminals respectively delivering two first potentials mutually phase-shifted with reference to each other;

at least said first set of electrode members is subdivided into at least two first sub-sets of electrode members; and said at least two first terminals are simultaneously coupled to at least said two first sub-sets of electrode members, respectively, in order to reduce at least the currents flowing in said second set of electrode members and in said means for selectively altering the AC voltage.

2. A display according to claim 1, wherein the layer having a memory effect electro-optical property comprises an electroluminescent layer superposed with a photoconductive layer.

3. A display according to claim 1, wherein the material of the layer having a memory effect electro-optical property is manganese-activated zinc sulfide, for example, or any other material which emits light under the effect of an electric voltage.

4. A display according to claim 1, wherein said first and second potentials said first two potentials are in mutual phase-opposition.

5. A display according to claim 1, wherein said AC sustain voltage generator means has four first terminals each delivering one of four first potentials in phase-quadrature relative to one another; said first set of electrode members being divided into four first subsets of electrode members; said four first terminals being simultaneously coupled to said four first sub-sets of electrode members, respectively.

6. A display according to claim 1, wherein said AC sustain voltage generator means has three first terminals each delivering one of three first potentials at phase intervals of 120 electrical degrees relative to one another; said first set of electrode members being subdivided into three sets of electrode members and said first three terminals being simultaneously coupled to three first sub-sets of electrode members respectively.

7. A display according to claim 1, wherein the voltage generator is coupled to at least one voltage transformer in order to generate voltages which are at mutually different phases.

8. A display according to claim 1, wherein one of the two sets of electrode members is made of aluminum, while the other family of electrodes is made of indium tin oxide or any other material which is conductive and transparent.

9. A display according to claim 1, wherein the two sets of electrodes are row and column electrodes are made of indium tin oxide or of any other material which is conductive and transparent.

10. A display according to claim 1, wherein said AC sustain voltage generator means has at least two second terminals respectively delivering two second potentials mutually phase-shifted with reference to each other;

said second set of electrode members being subdivided into at least two second sub-sets of electrode members; and said at least two second terminals being simultaneously coupled to at least two second sub-sets of electrode members, respectively.

11. A display according to claim 1, wherein variations relative to the sustain voltage which are used for changing a displayed image take place in time intervals lying between peaks in sustain current flowing along the electrode members of the subset affected.

12. A display according to claim 1 comprising pixel driving means including single polarity driving circuits of the push-pull type.

13. A display according to claim 1 comprising pixel driving means including two-polarity driving circuits of the push-pull type.

* * * * *